US006359392B1

(12) United States Patent
He

(10) Patent No.: US 6,359,392 B1
(45) Date of Patent: Mar. 19, 2002

(54) HIGH EFFICIENCY LED DRIVER

(75) Inventor: Fan He, Grayslake, IL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/754,485

(22) Filed: Jan. 4, 2001

(51) Int. Cl.[7] ..... F21V 3/00; H05B 37/00

(52) U.S. Cl. ..... 315/291; 323/222; 323/267; 323/282; 315/86

(58) Field of Search ..... 315/291, 209 R, 315/241 S, 200 A, 86, 185 S, 185 R, 312; 323/222, 282–285, 267, 902

(56) References Cited

U.S. PATENT DOCUMENTS 3,869,641 A * 3/1975 Goldberg ..... 315/135
4,673,865 A 6/1987 DeLuca et al. ..... 323/222
4,965,561 A 10/1990 Havel ..... 340/762
5,575,459 A * 11/1996 Anderson ..... 362/240
6,285,140 B1 * 9/2001 Ruston ..... 315/291

* cited by examiner

*Primary Examiner*—Don Wong
*Assistant Examiner*—Wilson Lee
(74) *Attorney, Agent, or Firm*—Brian M. Mancini

(57) ABSTRACT

A high efficiency light emitting diode (LED) driving circuit includes a first LED coupled in a forward current path between first and second nodes and a second LED being coupled in a reverse current path between the second and first nodes. A power supply is drives the first node with voltage pulses. A capacitor is coupled to the second node and stores charge while the power supply is driving the first LED in the forward current path during voltage pulses. A discharge circuit drains charge from the capacitor to drive the second LED in the reverse current path between voltage pulses.

20 Claims, 3 Drawing Sheets

— PRIOR ART —

— PRIOR ART —

HIGH EFFICIENCY LED DRIVER

FIELD OF THE INVENTION

This invention relates generally to light emitting diode (LED) circuits, and more particularly to driver circuits for driving LEDs.

BACKGROUND OF THE INVENTION

In portable radio communication devices it is desirable to prolong the operating time and battery life. To reduce the current drain from the battery it is desirable to develop circuits that achieve the lowest power consumption possible. Among those circuits, the display draws a disproportionate amount of current from the battery. The LED is widely used for back lighting in devices such as cellular phones due to its simpler driving circuit compared with the electroluminescent (EL) and fluorescent lighting its comparably lower cost and noise. However, the power consumption of LEDs is generally higher than the EL lights when multiple LEDs are used. In addition, the use of white LEDs, which is necessary for backlighting color liquid crystal displays (LCDs), incurs power considerations in that white LEDs have higher threshold voltages, which are often higher than the battery voltages. Thus DC-DC converter is required to boost the battery voltage and the overall power efficiency is reduced.

A radio communication device, such as a cellular phone, is typically powered from a battery, such as a lithium-ion battery, having a normal operating voltage of about 3.6 volts. Ideally, the device circuits are powered directly from the battery, however, some circuits such as light emitting diodes (LEDs) used in displays will not operate at this low voltage or provide deteriorated performance when the battery runs down, and it becomes necessary to add a DC-DC converter to step-up the voltage. However, the inductor type of DC-DC converter may have a typical efficiency of 85%, while the charge pump type of DC-DC converter usually has efficiencies less than 50% when the battery internal resistance is considered.

Referring to FIG. 1, a prior art LED inductive boost driver circuit is illustrated as described in U.S. Pat. No. 4,673,865, including an inductive switching power supply 102 to perform a DC-DC conversion. An inductor 104 is connected between a node 106 and a battery 108. A transistor 110 is connected to node 106. The anode of a diode 112 is also connected to node 106 and the cathode is connected to a node 114. A filter capacitor 116 is connected between node 114 and ground. A duty cycle modulator 118 is connected between node 114 and the base of transistor 110.

In operation, duty cycle modulator 118 periodically switches on and off transistor 110. When transistor 110 is switched on, current from battery 108 begins to flow through inductor 104, building up the magnetic field in the inductor as the current increases. When transistor 110 is switched off, the magnetic field collapses and a positive voltage pulse appears at node 106. Because inductor 104 is in series with battery 108, the voltage of the pulse at node 106 is greater than the battery voltage.

Thus, the periodic switching of transistor 110 causes a string of pulses to appear at node 106. These voltage pulses are then rectified and filtered by diode 112 and filter capacitor 116 to produce a multiplied DC voltage at output node 114. To regulate the output voltage, duty cycle modulator 118 samples the output voltage at DC output node 114 and adjusts the duty cycle of transistor 110 so that the DC output voltage remains substantially constant. A current limiting resistor 124 is coupled in series with the LED 122 along with a transistor 126 to control the activation of LED 122 via a control circuit (not shown). Although an improvement in the art, there is voltage drop across diode 112, and power consumed in current limiting resistor 124, which consumes battery power.

Illustrated in FIG. 2 is another prior art LED driver circuit that consumes less battery energy than the device of FIG. 1. The driver circuit uses switching power supply 102, LED 122 and transistor 126 that were previously described in conjunction with FIG. 1. Also, LED 122 and transistor 126 are mutually interconnected as in FIG. 1 and transistor 126 functions to control the activation of LED 122 as previously described. However, a capacitor 202 is connected between the anode of LED 122 and the pulse output node 106. A shunt diode 204 is connected to the junction of capacitor 202 and LED 122.

In operation, during a positive voltage pulse at output node 106, current flows through LED 122 via coupling capacitor 202. The capacitor plate 202*a* of capacitor 202 begins to charge negatively. Between voltage pulses, i.e. when transistor 110 conducts and momentarily grounds node 106, capacitor plate 202*a* goes below ground potential. When the negative potential on capacitor plate 202*a* is sufficient to overcome the small (typically 0.6 Volts) forward voltage drop across diode 204, the diode conducts, substantially discharging capacitor 202. Thus, diode 204 provides a means for discharging capacitor 202 during a portion of each period of the voltage waveform at output node 106.

Unfortunately, the discharge current is lost, lowering efficiency of the driver circuit. Moreover, this device, as well as that of FIG. 2, utilizes an inductor type boost converter to provide a high supply voltage, which increases cost and size of the circuit.

What is needed is a high efficiency LED driver circuit that can drive LEDs requiring higher voltage than available battery power. It would also be of benefit to eliminate the inductive type of boost circuits and the losses associated with current limiting resistors and switching circuits. It would also be advantageous to accomplish this in a low cost, simple circuit architecture.

DETAILED DESCRIPTION OF THE PREFERRED EMBODIMENT

The present invention provides a high efficiency LED driver with LED switching whereas prior art devices utilized diode or transistor switching. In particular, the present invention provides an improved driving circuit with more than 90% power efficiency for LED lighting devices. This is accomplished with LEDs requiring a driving voltage greater than the available power supply voltage. This is also accomplished without the typical inductive boost circuits or current limiting resistors of the prior art, and is implemented in a simple circuit architecture.

Figure 1:
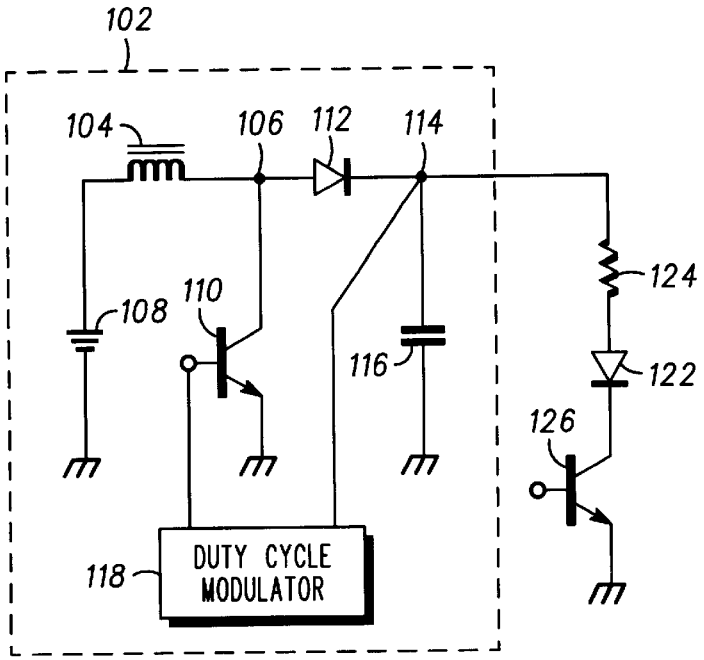
FIGS. 1 and 2 show schematic diagrams of a prior art LED driver circuits.
Figure 2:
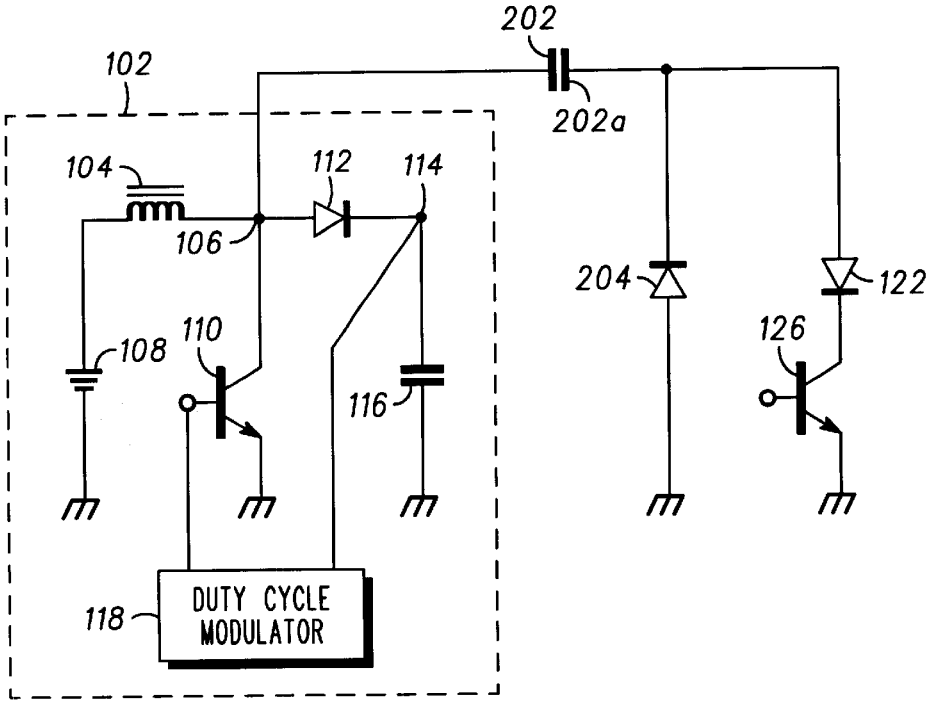
Figure 3:
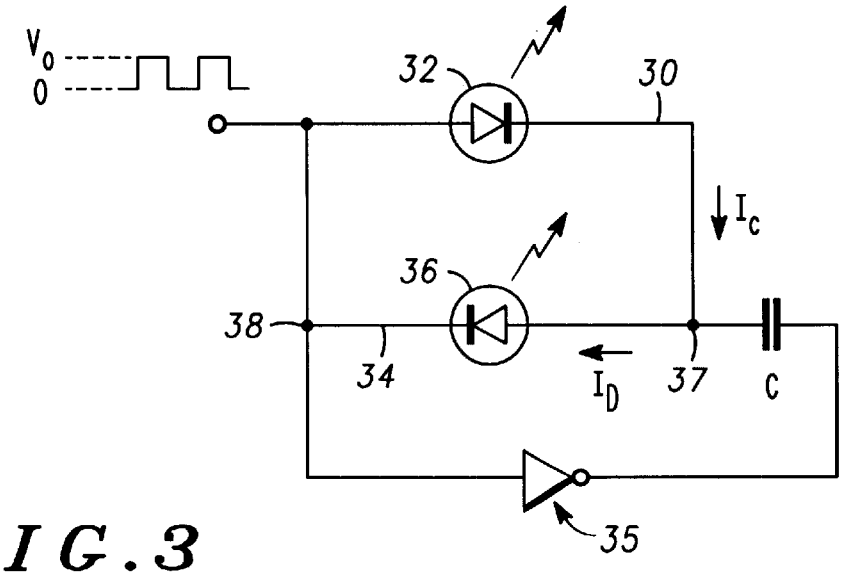
FIG. 3 shows a schematic diagram of a first embodiment of a LED driver circuit, in accordance with the present invention.
Figure 4:
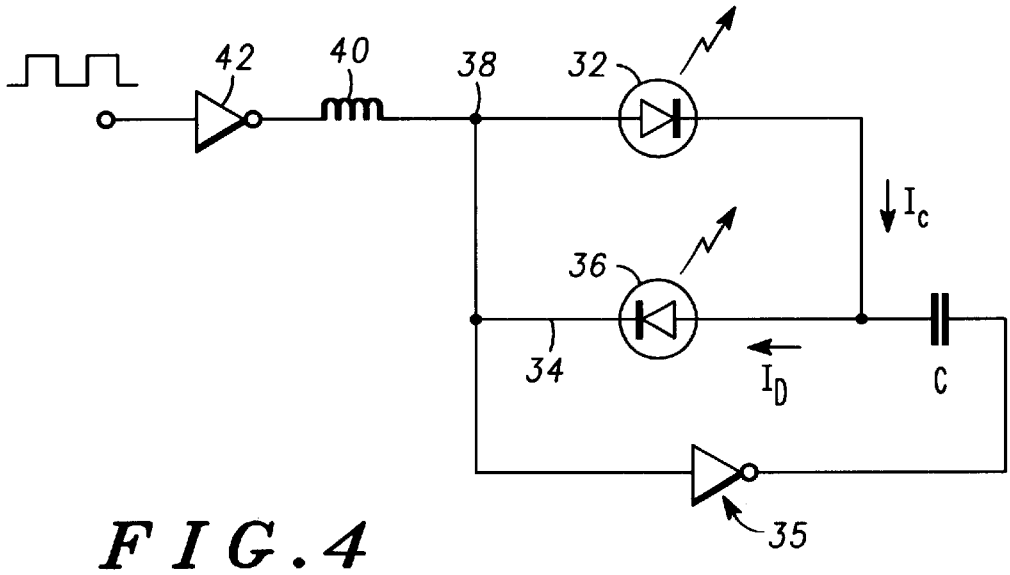
FIG. 4 shows a schematic diagram of a preferred embodiment of a LED driver circuit, in accordance with the present invention.

FIG. 3 shows a first embodiment of the light emitting diode (LED) driving circuit of the present invention. At least two LEDs 32, 36 are coupled between first and second nodes 38, 37. A first LED 32 is coupled in a forward current path 30 between first and second nodes 38, 37. A second LED 36 is coupled in a reverse current path 34 between the second and first nodes 37, 38. In particular, an anode of the first LED 32 is coupled to a cathode of the second LED 36 at the first node 38 and a cathode of the first LED 32 is coupled to an anode of the second LED 36 at the second node 37. The driving circuit also includes a power supply (not shown) for producing a substantially periodic waveform. Preferably, the waveform is substantially a square wave. The power supply is typically derived from a battery and is coupled to drive the first node 38 with voltage pulses. A capacitor C with first and second terminals is included. The first terminal is coupled to the second node 37 of the at least two LEDs 32, 36. The capacitor stores charge from the power supply while the power supply is driving the first LED 32 in the forward current path 30 during voltage pulses, i.e. when the voltage pulse is high. A discharge circuit 35 is coupled between the second terminal of the capacitor and the first node 38 of the at least two LEDs 32, 36. The discharge circuit 35 drains charge from the capacitor to drive the second LED 36 in the reverse current path 34 between voltage pulses, i.e. when the voltage pulse is low. Preferably, the discharge circuit is an inverter with an input coupled to the first node 38 and an output coupled to the second terminal of the capacitor. The stored charge of the capacitor boosts the voltage available to the second LED 36 over a voltage available from the voltage pulses of the power supply. This provides an advantage where the second LED 36 requires a higher drive voltage than the first LED 32. Is this case, the boosted voltage available during the discharge of the capacitor equalizes photonic output between the LEDs In a preferred embodiment, the power supply is buffered by an inverter 42 driven by a square wave as seen in FIG. 4, wherein components common to FIG. 3 are numbered similarly. In addition, a current limiting inductor 40 is coupled to the first node 38 to limit charge current to the capacitor. Because different charging and discharging current exist in the present invention it is beneficial to optimize the LEDs, capacitor, and a duty cycle of the power supply to provide uniform average photonic output from the LEDs In operation during charging, and referring back to FIG. 3, the current in the forward current path 30 going through the LED 32 is given by:

$$I_c=[V_0-V_{th}-V_c(t)]/R \tag{1}$$

Where $V_0$ is the power supply or battery voltage, $V_{th}$ is the LED threshold voltage, $V_c(t)$ is the voltage on the capacitor C, and R is the total circuit resistance. From equation (1), one can get:

$$dI_c/dt=-(1/R)dV_c(t)/dt \tag{2}$$

Because $dV_c(t)=\int I_c\, dt/C$, equation (2) becomes $$dI_c/dt+I_c/(RC)=0 \tag{3}$$

The solution of equation (3) is:

$$I_c=I_0 \exp(-[t/(RC)] \tag{4}$$

Where $$I_0=(V_0-V_{th}-V_{c0})/R \tag{5}$$

From equation (4), the average current for the charging process is given by:

$$I_{c_ave}=(V_0-V_{th}-V_{c0})C\{1-\exp(-[T_c/(RC)]\}/T_c \tag{6}$$

where $T_c$ is the charging time.

When discharging through the reverse current path 34, the capacitor C is in series with the power supply. Thus the total voltage is increased to the power supply voltage plus the voltage on the capacitor. The current during the discharging is given by the following equation:

$$I_D=[V_0-V_{thw}+V_c(t)]/R_D \tag{7}$$

From equation (7), one can get:

$$dI_D/dt=-(1/R_D)dV_c(t)/dt \tag{8}$$

From $dV_c(t)=-\int I_D dt/C$, one can get:

$$dV_c(t)/dt+V_c(t)/(R_DC)=-(V_0-V_{thw})/(R_DC) \tag{9}$$

where $R_D$ is the total resistance in the discharge circuit, and $V_{thw}$ is the second LED 36 threshold voltage. The solution of equation (9) is given by:

$$V_c(t)=[V_0-V_{thw}+V_{ch}]\exp[-t/(R_DC)]+V_{thw}-V_0 \tag{10}$$

where $V_{ch}$ is the voltage across the capacitor before discharging. The current during the discharge process can be calculated with equation (7) and equation (10).

$$I_D=[V_0-V_{thw}+V_{ch}]\{1-\exp[-t/(R_DC)]\}/R_D \tag{11}$$

The average discharging current can be computed from (11):

$$I_{D_ave}=C[V_0-V_{thw}+V_{ch}]\exp[-T_D/(R_DC)]/T_D \tag{12}$$

The efficiency can be further improved by adding an inductor in the circuit (40 of FIG. 4). With an inductor in series with the capacitor in the discharging path to reduce the maximum discharging current, the differential equation for the current becomes:

$$d^2I/dt^2+(R/L)dI/dt+I/(CL)=0 \tag{13}$$

The solution is given by:

$$I(t)=A_1e^{At}+A_2e^{Bt} \tag{14}$$

Where A1 and A2 are two constants to be determined by the initial conditions. The constant A and B are given by the following expressions:

$$A=-0.5R/L+0.5*[(R/L)^2-4/(CL)]^{1/2} \tag{15}$$

$$B=-0.5R/L-0.5*[(R/L)^2-4/(CL)]^{1/2} \tag{16}$$

It is known that the current is zero at the moment when the circuit is connected, then the current ramps up at a rate determined by the nature of the circuit. From this initial condition, one can find that:

$$A_1=-A_2 \tag{17}$$

At the moment when the circuit starts discharging, it cannot be determined if there is a capacitor in the circuit by monitoring the current. Thus, one can induce that the gradient of the current is the same as the circuit with the same initial voltage but without the capacitor at the moment when the circuit starts discharging. This gives another initial condition as follows:

$$(dI/dt)_{t=0}=(V_0+V_{ch}-V_{thw})/L \quad (18)$$

From equations (14) through (18), one can get:

$$I(t)=[(V_0+V_{ch}-V_{thw})/L][(R/L)^2-4/(CL)]^{-1/2}(e^{At}-e^{Bt}) \quad (19)$$

With this complete solution, the maximum discharging current can be found and compared with the maximum current in the circuit without inductance. By setting dI/dt=0, we have:

$$(Ae^{A\tau}-Be^{B\tau})=0 \quad (20)$$

Where $\tau$ is the time when the discharging current reaches its maximum. By substituting equations (15) and (16) into equation (20), one obtains:

$$\tau=[(R/L)^2-4/(CL)]^{-1/2}\ln\{[R+(R^2-4L/C)^{1/2}]/[R-(R^2-4L/C)^{1/2}]\} \quad (21)$$

Substituting equation (21) into equation (19) gives the maximum discharging current:

$$I_{Lmax}=[(V_0+V_{ch}-V_{thw})/R]e^{-0.5\tau(R/L)}R(C/L)^{1/2} \quad (22)$$

For any given value of C, a value for L can be found to meet the requirement that:

$$e^{-0.5\tau(R/L)}R(C/L)^{1/2}<1 \quad (23)$$

In this way, the maximum discharging current can be reduced by adding an inductor in series with the capacitor. Maximum current can also be reducing by limiting the discharging time, because the peak current does not happen at the beginning of the discharge cycle when there is inductance in the circuit.

The efficiency of the driving circuit (with inductive current limitation) is determined by the ratio of the power consumed by the LED and the total power from the power source, which is described in the following equation $$\eta=(I_{D_ave}V_{thw}T_d+I_{C_ave}V_{th}T_c)/(V_{in}I_{D_ave}T_d+V_{in}I_{C_ave}T_c)$$

Given typical values of $I_{C_ave}$=170 mA, $I_{D_ave}$=500 mA, $V_{thw}$=3.8V for a white LED, $V_{th}$=1.8V for a green/red/yellow LED and $V_{in}$=3.6V, the efficiency of the present invention is $\eta$=0.91.

Color LCDs will become very popular in the future hand held devices. Thus white LEDs will also become popular in these devices due to the backlighting requirements of the color LCD. Although white LED drivers are available in the marketplace, none of the designs are high efficiency and require high driving voltages. The present invention can reduce the power consumption by more than 25%, which results in longer battery life. Further, LEDs have recently been incorporated into flashlights for their high photon efficiency. The present invention allows reduces the power consumption in these, so that the battery life can be 25% longer than a LED flashlight a using constant current driven method.

Many considerations must be made in optimizing a circuit for the various LEDs available in the marketplace, their applications and the availability of lithium ion batteries for power sources. For example, With exception of GaP red LEDs, blue LEDs and white LEDs, most of the modern ultra-bright LEDs have maximum efficiency at currents near or just below their maximum rated current. Also, with the exception of GaP red, blue LEDs and white LEDs, LED optical characteristics in the high-power zone are excellent, permitting effective pulse driving. In other words, for the same optical output the green, red and yellow LEDs can be driven with very high pulse current but lower average current. Blue and white LEDs have higher optical efficiency at lower current. LEDs also have the same characteristics as a general purpose diode, thus they can be used as switch device such as that in a charge pump. The threshold voltage of green, yellow and red LEDs ranges from 1.8V to 2.4V. Although, a buck mode switch regulator can be used to increase the power efficiency, this results in cost increase. In contrast, the threshold voltage of blue and white LEDs ranges from 3.3V to 4.2V. A lithium ion battery voltage typically ranges from 3.0V to 4.2V with 95% of capacity in the range from 3.4V to 4.2V.

With the combination of pulse driving, using red, green or yellow LEDs as switching diode in a charge pump, and using the charge pump output to drive blue or white LEDs, the present invention can have high power efficiency of 90% or more. Table 1 compares the power consumption of the present invention compared to prior art light drivers.

TABLE 1

Comparison of different lighting technologies

| | LED driver of present invention | Constant current LED driver | Compact fluorescent |
|---|---|---|---|
| Lighting components | 8 green LED and 4 white LED | 8 green LED and 2 white LED | 2 white CCFL tube + 8 green LED |
| Battery voltage | 3.6 V | 3.6 V | 3.6 V |
| DC—DC converter | LED charge pump | Boost converter | Boost converter |
| Driving method | Pulsed | Constant current | High voltage AC |
| Average current for each green LED | 4 mA | 5 mA | 5 mA |
| Average current for each white LED | 10 mA | 20 mA | N/A |
| Average FL current drain from battery | N/A | N/A | 52 mA |
| Total average current drain from battery | 72 mA | 98 mA | 80 mA |

In the prior art drivers, it is assumed that each green LED is driven with a two-volt buck converter with 80% efficiency, resulting in an equivalent 3.5 mA current draw from a 3.6V battery. Similarly, each white LED is driven with a five-volt boost converter with 80% efficiency, resulting in an equivalent 35 mA current draw from a 3.6V battery.

In order to get high efficiency driving circuits, issues like the tolerance of the LED threshold voltage, the LED forward current—photon efficiency relation and dimming control need to be resolved. The following preferred embodiments provide high efficiency designs for practical applications.

Figure 5:
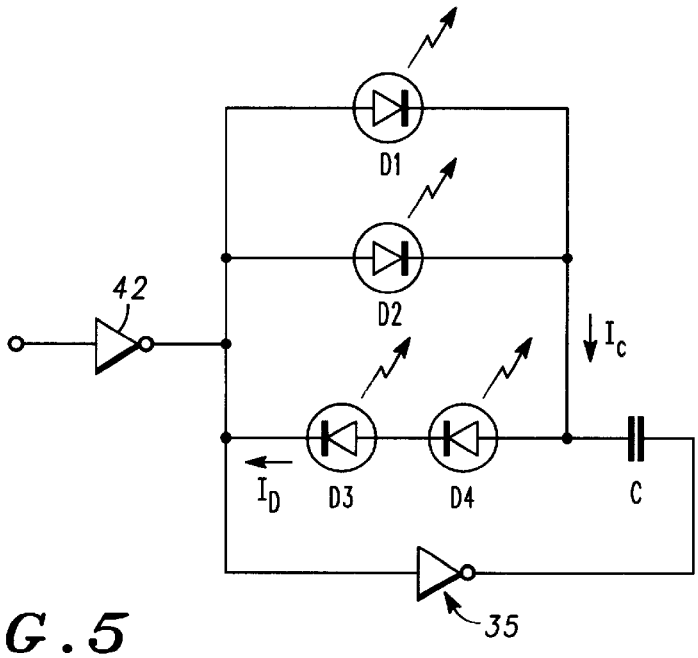
FIG. 5 shows a schematic diagram of a first alternate embodiment of a LED driver circuit, in accordance with the present invention.

FIG. 5 shows a simplified schematic diagram for a green LED driver for monochromatic lighting, wherein the power supply charges capacitor C through parallel LEDs D1 and D2. Then C discharges through green series LEDs D3 and D4 as more voltage is available in the discharge cycle to drive series connected LEDs. As a result, the LED brightness of four LEDs is obtained at the current drain of three LEDs. In practice, more parallel LEDs can be provided in the forward current path and parallel sets of two series LEDs can be provided in the reverse path to increment brightness as needed.

Figure 6:
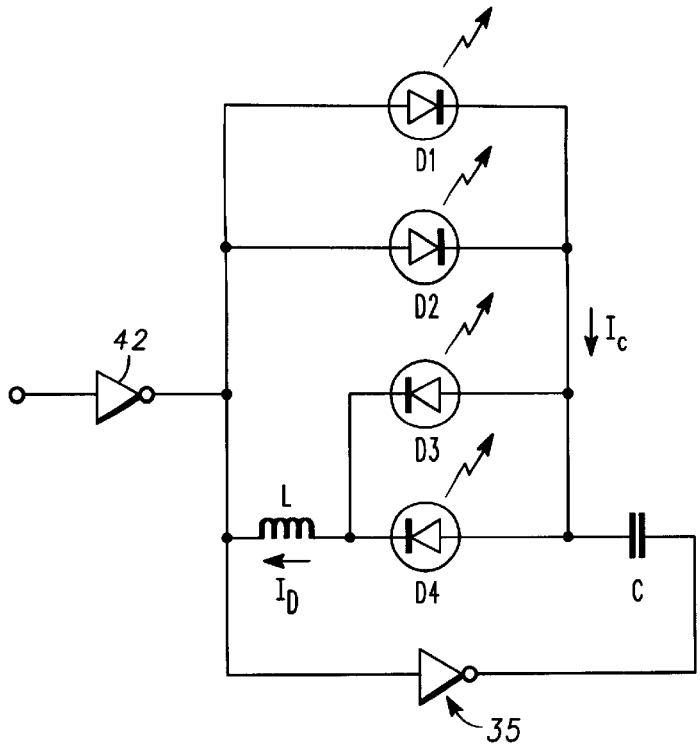
FIG. 6 shows a schematic diagram of a second alternate embodiment of a LED driver circuit, in accordance with the present invention.

FIG. 6 shows a simplified schematic diagram for a RGB LED driver for color LCD lighting, wherein the power supply charges capacitor C through a red LED D1 and a yellow LED D2. Then C discharges through parallel blue LEDs D3 and D4 as more voltage is available in the discharge cycle to drive the higher threshold blue (or white) LEDs. The reason to use blue LEDs in parallel is to lower the maximum current through the blue LED and improve photon efficiency. In the case when the forward current charge path DC resistance is very small, an inductor L can be put in the charge path to achieve zero current switching and maximize the electrical efficiency. Another inductor L in the discharge path can reduce peak discharge current and improve the photon efficiency. If the inductor L is put in series with the capacitor, both charge peak current and discharge peak current can be reduced, and thus the highest photon efficiency can be achieved. Similarly, a green and white LED driver for color LCD lighting can be provided with green LEDs in the charge circuit path and white LEDs in the discharge current path.

It is also envisioned that a comparator (not shown) can be used to monitor the charging voltage on C when the circuit is charging through the forward current path, such that once the voltage on C is greater than a charging threshold voltage, the comparator can direct C to start discharging through the discharge current path by having the threshold voltage of the comparator change to a higher discharge threshold voltage. When the discharging voltage is lower than the discharge threshold voltage, the circuit starts charging C and changes the comparator threshold to the charging threshold voltage from the discharging threshold voltage. This can be used advantageously as a brightness, contrast, or dimming control.

While the invention has been described in the context of a preferred embodiment, it will be apparent to those skilled in the art that the present invention may be modified in numerous ways and may assume many embodiments other than that specifically set out and described above. Accordingly, it is intended by the appended claims to cover all modifications of the invention that fall within the broad scope of the invention.

What is claimed is:

1. A light emitting diode (LED) driving circuit, comprising:

at least two LEDs coupled between first and second nodes, a first LED being coupled in a forward current path between first and second nodes and a second LED being coupled in a reverse current path between the second and first nodes, respectively;

a power supply for producing a substantially periodic waveform, the power supply being coupled to drive the first node with voltage pulses;

a capacitor with a first and a second terminal, the first terminal is coupled to the second node of the at least two LEDs, the capacitor stores charge from the power supply while the power supply is driving the first LED in the forward current path during voltage pulses; and a discharge circuit coupled between the second terminal of the capacitor and the first node of the at least two LEDs, wherein the discharge circuit drains charge from the capacitor to drive the second LED in the reverse current path between voltage pulses.

2. The circuit of claim 1, wherein the periodic waveform is substantially a square wave.

3. The circuit of claim 1, wherein the discharge circuit is an inverter with an input coupled to the first node and an output coupled to the second terminal of the capacitor.

4. The circuit of claim 1, wherein the power supply includes an inverter driven by a square wave.

5. The circuit of claim 1, wherein the stored charge of the capacitor boosts the voltage available to the second LED over a voltage available from the voltage pulses of the power supply.

6. The circuit of claim 5, wherein the second LED requires a higher drive voltage than the first LED such that the boosted voltage available during the discharge of the capacitor equalizes photonic output between the LEDs.

7. The circuit of claim 1, wherein the LEDs, capacitor, and a duty cycle of the power supply are optimized to provide uniform average photonic output from the LEDs.

8. The circuit of claim 1, wherein the at least two LEDs include a first and a second LED, an anode of the first LED being coupled to a cathode of the second LED at the first node and a cathode of the first LED being coupled to an anode of the second LED at the second node.

9. The circuit of claim 1, further comprising an inductor coupled to the first node to limit charge current to the capacitor.

10. The circuit of claim 1, wherein the at least two LEDs includes two LEDs coupled in the forward current path and two LEDs coupled in the reverse current path, the LEDs in each current path being coupled in one of the group of a parallel connection and a series connection.

11. The circuit of claim 10, wherein the LEDs in the forward current path are further connected in series with a current limiting inductor.

12. The circuit of claim 10, wherein the LEDs in the forward current path are connected in series and the LEDs in the reverse current path are connected in parallel.

13. A light emitting diode (LED) driving circuit, comprising:

at least two LEDs coupled between first and second nodes, a first LED being coupled in a forward current path between first and second nodes and a second LED being coupled in a reverse current path between the second and first nodes, respectively, an anode of the first LED being coupled to a cathode of the second LED at the first node and a cathode of the first LED being coupled to an anode of the second LED at the second node;

a power supply for driving the first node with voltage pulses having a substantially square waveform;

a capacitor with a first and a second terminal, the first terminal is coupled to the second node of the at least two LEDs, the capacitor stores charge from the power supply while the power supply is driving the first LED in the forward current path during voltage pulses; and a discharge circuit coupled between the second terminal of the capacitor and the first node of the at least two LEDs, wherein the discharge circuit drains charge from the capacitor to drive the second LED in the reverse current path between voltage pulses, the stored charge of the capacitor boosts the voltage available to the second LED over a voltage available from the voltage pulses of the power supply.

14. The circuit of claim 13, wherein the discharge circuit is an inverter with an input coupled to the first node and an output coupled to the second terminal of the capacitor.

15. The circuit of claim 13, wherein the power supply includes an inverter driven by a square wave.

16. The circuit of claim 13, wherein the second LED requires a higher drive voltage than the first LED such that the boosted voltage available during the discharge of the capacitor equalizes photonic output between the LEDs.

17. The circuit of claim 13, wherein the LEDs, capacitor, and a duty cycle of the power supply are optimized to provide uniform average output from the LEDs.

18. The circuit of claim 13, further comprising an inductor coupled to the first node to limit charge current to the capacitor.

19. The circuit of claim 13, wherein the at least two LEDs includes two LEDs coupled in the forward current path and two LEDs coupled in the reverse current path, the LEDs in each current path being coupled in one of the group of a parallel connection and a series connection.

20. A light emitting diode (LED) driving circuit, comprising:

at least two LEDs coupled between first and second nodes, a first LED being coupled in a forward current path between first and second nodes and a second LED being coupled in a reverse current path between the second and first nodes, respectively, an anode of the first LED being coupled to a cathode of the second LED at the first node and a cathode of the first LED being coupled to an anode of the second LED at the second node;

a power supply for driving the first node with voltage pulses having a substantially square waveform;

a capacitor with a first and a second terminal, the first terminal is coupled to the second node of the at least two LEDs, the capacitor stores charge from the power supply while the power supply is driving the first LED in the forward current path during voltage pulses; and a discharge circuit coupled between the second terminal of the capacitor and the first node of the at least two LEDs, wherein the discharge circuit drains charge from the capacitor to drive the second LED in the reverse current path between voltage pulses, the stored charge of the capacitor boosts the voltage available to the second LED over a voltage available from the voltage pulses of the power supply, the second LED requires a higher drive voltage than the first LED such that the boosted voltage available during the discharge of the capacitor equalizes photonic output between the LEDs.

* * * * *